United States Patent [19]

Keidar et al.

[11] Patent Number: 4,886,161

[45] Date of Patent: Dec. 12, 1989

[54] CONTAINER FOR CIGARETTES, AND CARDBOARD BLANK FOR USE IN MAKING SAME

[76] Inventors: Itzhak Keidar, 19 Chisin St.; Asher Dromi, 11 Shderot Yotzer, both of Tel Aviv; Menahem Tilman, 34 Shaldag St., Hofit; Joseph Harel, 38 Hagefen St., Ramat Hasharon, all of Israel

[21] Appl. No.: 301,093

[22] Filed: Jan. 25, 1989

[51] Int. Cl.[4] ..... B65D 85/10

[52] U.S. Cl. ..... 206/246; 229/160.1; 229/103; 229/146; 206/496

[58] Field of Search ..... 206/246, 496; 229/103, 229/146, 160.1

[56] References Cited

U.S. PATENT DOCUMENTS

| | | | |
|---|---|---|---|
| 1,540,841 | 6/1925 | Johnson | 206/246 |
| 2,849,154 | 8/1958 | Gartrell et al. | 206/246 |
| 3,018,877 | 1/1962 | Posavic | 206/246 |
| 3,024,902 | 3/1962 | Taylor | 206/246 |
| 3,028,950 | 4/1962 | Content | 206/246 |
| 3,064,799 | 11/1962 | Butler | 206/246 |
| 3,096,878 | 7/1963 | Whitley et al. | 206/246 |
| 3,112,029 | 11/1963 | Davey | 206/246 |
| 3,388,706 | 6/1968 | Muirheid | 206/246 |
| 3,888,264 | 6/1975 | Baclit | 206/246 |
| 4,789,059 | 12/1988 | Kim | 206/246 |

FOREIGN PATENT DOCUMENTS

| | | | |
|---|---|---|---|
| 0650723 | 10/1962 | Canada | 206/246 |
| 0660800 | 4/1963 | Canada | 206/246 |
| 1430235 | 3/1976 | United Kingdom | 229/160.1 |

*Primary Examiner*—Stephen P. Garbe
*Assistant Examiner*—Kathryn M. Stemann
*Attorney, Agent, or Firm*—Benjamin J. Barish

[57] ABSTRACT

A container for containing a plurality of cigarettes, comprises a front wall panel, a rear wall panel, two side wall panels, and two end walls. One of the end walls, namely the bottom wall, is constituted of a pair of panels slitted and formed with fold lines such that they may be folded against each other to a closed condition to form the respective container end wall, or may be unfolded to an open condition and retained in the open condition to form an extension of the container to serve as an ashtray.

17 Claims, 1 Drawing Sheet

FIG 1
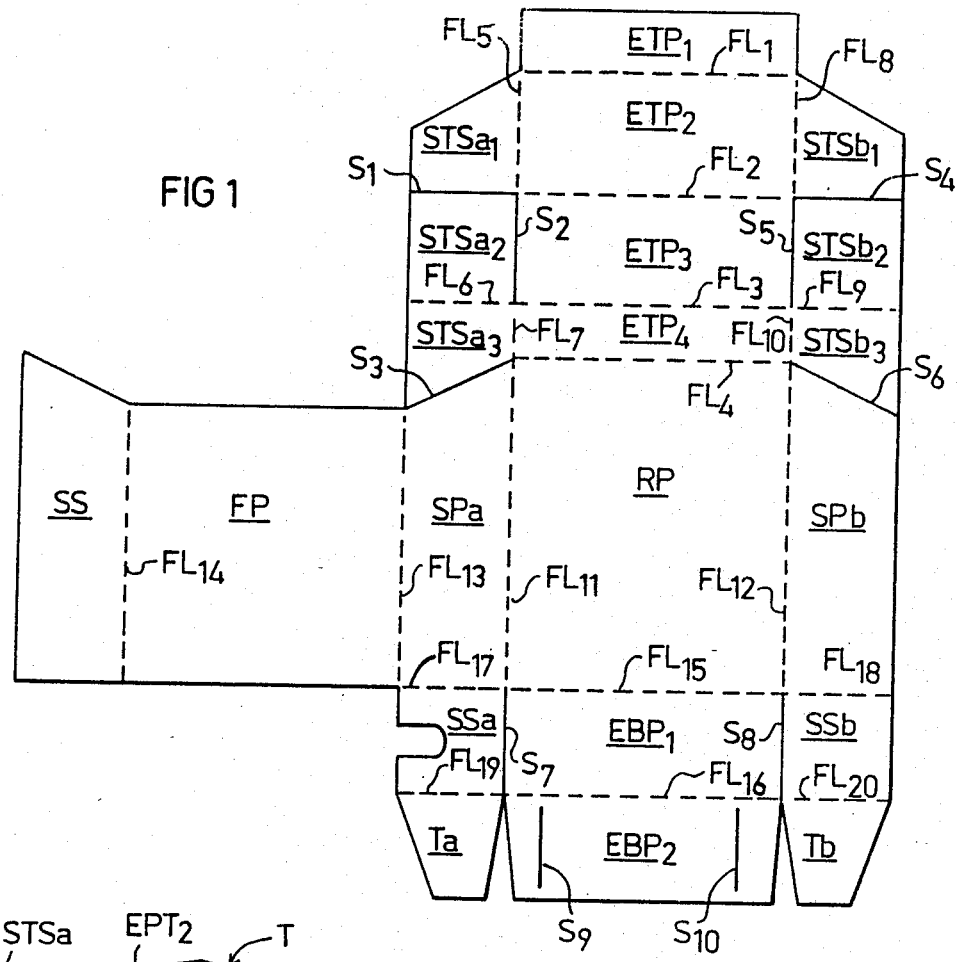
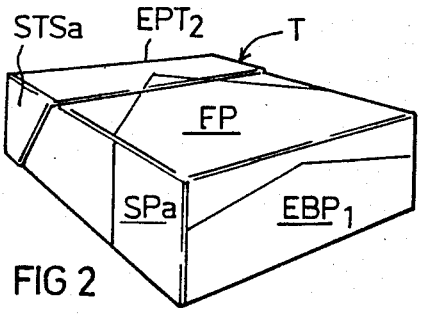
FIG 2
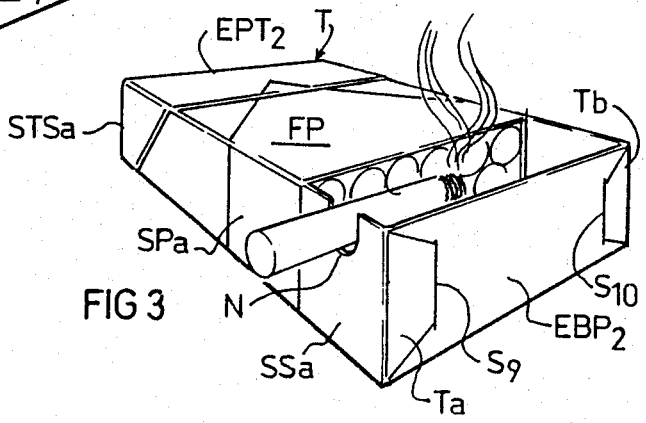
FIG 3

CONTAINER FOR CIGARETTES, AND CARDBOARD BLANK FOR USE IN MAKING SAME

BACKGROUND OF THE INVENTION

The present invention relates to a container for containing a plurality (pack) of cigarettes, and also to a cardboard blank for use in making such a container.

Containers for cigarettes are conventionally made of cardboard, which is first prepared as a blank of the appropriate configuration and having the appropriate fold lines and slits enabling the blank to be folded into the form of the container and then fixed in that form. The conventional construction permits the container to perform only the single function of containing the plurality of cigarettes.

An object of the present invention is to provide a container, and also a cardboard blank for use in making such a container, which enables the container to perform an additional function, namely of serving as an ashtray which may be used for receiving the ashes of a cigarette and also for temporarily supporting a cigarette with the lit end overlying the ashtray.

BRIEF SUMMARY OF THE INVENTION

According to the present invention, there is provided a container for containing a plurality of cigarettes, comprising: a front wall panel, a rear wall panel, two side wall panels, and two end walls; characterized in that one of the end walls, preferably the bottom end wall, is constituted of a pair of end wall panels slitted and formed with fold lines such that the end wall panels are normally folded against each other to a closed condition to form the respective container end wall, but may be unfolded to an open condition and retained in the open condition to form an extension of the container to serve as an ashtray.

More particularly, the plurality of panels includes an inner end wall panel connected by a fold line to the respective end of the rear panel, and an outer end wall panel connected by a fold line to the inner end wall panel. Each of the side wall panels includes a section aligned with the respective end of the inner end wall panel but separated therefrom by a slit, and a tab aligned with, but separated from, the respective end of the outer end wall panel. The outer end wall panel is normally folded against the inner end wall panel in the closed condition of the end wall panels, and is formed with slits for receiving the tabs in the side wall panels for supporting the outer end wall panel in the open condition of the end wall panels.

According to a further feature in the described preferred embodiment, one of the side wall sections is notched along its outer edge for supporting a cigarette in the open condition of the end wall panels.

According to a still further feature in the described preferred embodiment, the front wall panel is laterally of a side wall panel and is connected thereto via a fold line.

It will thus be seen that the foregoing structural features enables the container to be used not only for its conventional function of containing a plurality of cigarettes, but also for the additional function of serving as an ashtray which may be used to receive the ashes of a burning cigarette, or as a temporary support for a cigarette with its lit end over the ashtray.

Further features and advantages of the invention will be apparent from the description below.

BRIEF DESCRIPTION OF THE DRAWINGS

The invention is herein described, by way of example only, with reference to the accompanying drawings, wherein:

FIG. 1 illustrates one form of cardboard blank constructed in accordance with the invention for preparing a cigarette container;

FIG. 2 illustrates the cardboard blank of FIG. 1 folded in its conventional form for performing its normal function of containing a plurality of cigarettes; and FIG. 3 illustrates the container of FIG. 2 opened at its bottom end to form an extension capable of serving the additional function of an ashtray.

DESCRIPTION OF A PREFERRED EMBODIMENT

The cardboard blank for making the container is initially cut to the configuration illustrated in FIG. 1. The blank is formed with a combination of fold lines and slits which enable the blank to be folded into a conventional cigarette container as illustrated in FIG. 2, or to be opened at one end wall (namely at the bottom end) to form an extension capable of serving as an ashtray as illustrated in FIG. 3.

More particularly, the cardboard blank illustrated in FIG. 1 is formed with the following combination of fold lines (each identified as "FL") and slits (each identified as "S"):

The portion of the cardboard blank constituting the top of the container is formed with fold lines $FL_1$, $FL_2$, $FL_3$ and $FL_4$, defining interconnecting top panels $ETP_1$, $ETP_2$, $ETP_3$ and $ETP_4$, respectively. In addition, the blank is formed with fold lines $FL_5$, $FL_6$, $FL_7$ and with slits $S_1$, $S_2$ and $S_3$, on one side of panels $ETP_2$, $ETP_3$ and $ETP_4$ to form side top sections $STSa_1$, $STSa_2$ and $STSa_3$ interconnected with the top panels $ETP_2$, $ETP_3$, $ETP_4$. Similar fold lines $FL_8$, $FL_9$, $FL_{10}$ and slits $S_4$, $S_5$, $S_6$ are formed on the opposite side of the top panels $ETP_2$, $ETP_3$, $ETP_4$, to form side top sections $STSb_1$, $STSb_2$, $STSb_3$ interconnecting with the top panels $ETP_2$, $ETP_3$ and $ETP_4$.

The foregoing construction at the upper end of the cardboard blank is basically the same as in a conventional container. It enables the top portion of the cardboard blank to form the pivotal top T (FIGS. 2, 3) of the container, by folding panel $ETP_1$ against, and bonding it to, the inner face of panel $ETP_2$; folding side sections $STSa_2$ and $STSb_2$ against, and bonding them to, the inner face of panel $ETP_3$; and then folding sections $STSa_1$ and $STSb_1$ against, and bonding them to, the outer face of side sections $STSa_3$ and $STSb_3$. The top is pivotal to the rear panel RP of the container along fold line $FL_4$.

The remaining structure of the cardboard blank illustrated in FIG. 1 differs from the conventional construction in the following manner:

The cardboard blank illustrated in FIG. 1 is formed with fold lines $FL_{11}$ and $FL_{12}$ on opposite sides of the rear panel RP, which fold lines interconnect the rear panel with the two side panels $SP_a$, $SP_b$, respectively. The front panel FP extends laterally of the side panel SPa and is interconnected therewith by a fold line $FL_{13}$. The opposite side of the front panel is interconnected via fold line $FL_{14}$, with side section SS which may be folded against and bonded to side panel $SP_b$ to thereby define the front, the rear and the two side walls of the container.

The bottom wall of the container, at the opposite end to the above-described top wall, is defined by two end bottom panels $EBP_1$, $EBP_2$. The inner end bottom panel $EBP_1$ is interconnected with the lower end of the rear panel RP by fold line $FL_{15}$, and the outer end bottom panel $EBP_2$ is connected to the inner end bottom panel $EBP_1$ by fold line $FL_{16}$.

In addition, the side panels SPa, SPb are integrally formed with side sections SSa, SSb each separated from its respective side panel by fold lines $FL_{17}$ and $FL_{18}$ respectively. The side sections SSa, SSb are aligned with but separated from the inner end panel $EBP_1$ by slits $S_7$, $S_8$ aligned with fold lines $FL_{11}$ and $F_{12}$, respectively. Each of the side sections SSa, SSb is formed with a tab Ta, Tb aligned with but separated from the respective end of the outer end panel $EBP_2$, and is joined to the respective side section SSa, SSb by fold lines $FL_{19}$, $FL_{20}$. As shown in FIG. 1, tabs Ta, Tb are tapered, decreasing in width in the outward direction, to facilitate their insertion into slits $S_9$, $S_{10}$ formed in the respective end of panel $EBP_2$.

In addition, side section SSa is formed with a notch N at its outer edge for supporting a cigarette in the open condition of the end wall panels when the end wall is opened to define an ashtray, as illustrated in FIG. 3.

The upper portion of the blank illustrated in FIG. 1 is folded and bonded in the usual manner as described above for forming the pivotal top T of the container. The remainder of the blank is folded to form the front, rear, side and bottom walls of the conventional container, as illustrated in FIG. 2, in the following manner:

First, the blank is folded along fold lines $FL_{11}$, $FL_{12}$, $FL_{13}$ and $FL_{14}$, and the side section SS is placed against and bonded to the side panel SPb, to thereby form the front, rear and side walls of the container. To form the bottom wall, panel $EBP_2$ is folded against the inner face of panel $EBP_1$, and the tabs Ta, Tb are folded against the inner faces of the side sections SSa, SSb, respectively. The side sections SSa, SSb are then folded against the inner face of panel $EBP_1$, and may be retained in such a position either by strong fold lines, or by a light adhesive.

This is the condition of the blank when originally folded as shown in FIG. 2 to serve as the usual container for a plurality of cigarettes as sold to the consumer.

Whenever the consumer wishes to convert the illustrated container also for use as an ashtray, as illustrated in FIG. 3, the consumer may open the bottom end wall of the container in the following manner:

First, the consumer forces the bottom end wall to open along fold lines $FL_{15}$ and $FL_{16}$, bringing panels $EBP_1$, $EBP_2$ parallel to the rear panel RP. The side sections SSa, SSb, together with their respective tabs Ta, Tb, are then folded to their open condition along fold lines $FL_{17}$, $FL_{18}$, $F_{19}$ and $F_{20}$.

Panel $EBP_2$ is then folded along fold line $FL_{16}$ so as to be perpendicular to panel $EBP_1$, and is retained in this folded condition by inserting tabs Ta, Tb into slits $S_9$ and $S_{10}$ in panel $EBP_2$.

It will thus be seen that when the container is open in this manner, as illustrated in FIG. 3, the container is extended by the width of panel $EBP_1$ to form an ashtray which may be used for receiving the ashes of a lit cigarette, and also for supporting the cigarette on the ashtray by inserting it into notch N in side section SSa.

While the invention has been described with respect to one preferred embodiment, it will be appreciated that many variations, modifications and other applications of the invention may be made.

What is claimed is:

1. A container for containing a plurality of cigarettes, comprising: a front wall panel, a rear wall panel, two side wall panels, and two end walls; characterized in that one of said end walls is constituted of a pair of end wall panels slitted and formed with fold lines such that said end wall panels are normally folded against each other to a closed condition to form the respective container end wall, but may be unfolded to an open condition and retained in said open condition to form an extension of said container to serve as an ashtray.

2. The container according to claim 1, wherein said pair of end wall panels include an inner end wall panel connected by a fold line to the respective end of said rear panel, and an outer end wall panel connected by a fold line to said inner end wall panel; each of said side wall panels including a section aligned with the respective end of the inner end wall panel but separated therefrom by a slit, and a tab aligned with, but separated from, the respective end of the outer end wall panel; said outer end wall panel being normally folded against said inner end wall panel in said closed condition of the end wall panels, and being formed with slits for receiving the tabs in the side wall panels for supporting the outer end wall panel in said open condition of the end wall panels.

3. The container according to claim 2, wherein one of the side wall sections is notched along its outer edge for supporting a cigarette in said open condition.

4. The container according to claim 1, wherein said end wall panels are formed at the bottom end of the container.

5. The container according to claim 1, wherein said front wall panel is laterally of a side wall panel and is connected thereto via a fold line.

6. The container according to claim 5, wherein the upper edge of said front wall panel is below the upper edge of said rear wall panel.

7. A container for containing a plurality of cigarettes, comprising:

a front wall panel, a rear wall panel, two side wall panels, a bottom end wall, and a top end wall;

the bottom end wall including an inner panel connected by a fold line to the respective end of said rear panel, and an outer panel connected by a fold line to said inner panel; each of said side wall panels including a section aligned with the respective end of the inner panel but seperated therefrom by a slit, and a tab aligned with, but separated from, the respective end of said outer panel; said outer panel being folded against said inner panel in a closed condition of the bottom end wall panels, and being formed with slits for receiving the tabs in the side wall panels for supporting the outer panel in an open condition.

8. The container according to claim 7, wherein one of the side wall sections is notched along its outer edge for supporting a cigarette in said open condition.

9. The container according to claim 7, wherein said top end wall is carried by a top container section pivotal to the remainder of the container.

10. The container according to claim 7, wherein said front wall panel is laterally of a side wall panel and is connected thereto via a fold line.

11. The container according to claim 7, wherein the upper edge of said front wall panel is below the upper edge of said rear wall panel.

12. A cardboard blank for use in making a container for containing a plurality of ciqarettes, comprising: a front wall panel, a rear wall panel, two side wall panels, and two-end walls; characterized in that one of said end walls is constituted of a pair of end wall panels slitted and formed with fold lines such that said end wall panels may be folded against each other to a closed condition to form the respective container end wall, or may be unfolded to an open condition and retained in said open condition to form an extension of said container to serve as an ashtray.

13. A cardboard blank according to claim 12, wherein said pair of end wall panels includes an inner end wall panel connected by a fold line to the respective end of said rear panel, and an outer end wall panel connected by a fold line to said inner end wall panel; each of said side wall panels including a section aligned with the respective end of the inner end wall panel but separated therefrom by a slit, and a tab aligned with, but separated from, the respective end of the outer end wall panel; said outer end wall panel being foldable against said inner end wall panel in said closed condition of the end wall panels, and being formed with slits for receiving the tabs in the side wall panels for supporting the outer end wall panel in said open condition of the end wall panels.

14. A cardboard blank according to claim 13, wherein one of the side wall sections is notched along its outer edge for supporting a cigarette when the blank is folded into a container and said end wall panels are in said open condition.

15. A cardboard blank according to claim 12, wherein said end wall panels are formed at the bottom end of the container.

16. A cardboard blank according to claim 12, wherein said front wall panel is laterally of a side wall panel and is connected thereto via a fold line.

17. A cardboard blank according to claim 12, wherein the upper edge of said front wall panel is below the upper edge of said rear wall panel.

* * * * *